US005254030A

United States Patent [19]

Ostendorff et al.

[11] Patent Number: 5,254,030

[45] Date of Patent: Oct. 19, 1993

[54] RAPID ACTION TOY VEHICLE LAUNCHER

[75] Inventors: Eric C. Ostendorff, Torrance; Toshio Yamasaki, Long Beach, both of Calif.

[73] Assignee: Mattel, Inc., El Segundo, Calif.

[21] Appl. No.: 929,965

[22] Filed: Aug. 17, 1992

[51] Int. Cl.[5] ..... A63H 29/00; A63H 17/00

[52] U.S. Cl. ..... 446/430; 273/129 S; 124/26; 124/49; 446/475

[58] Field of Search ..... 446/430, 429, 424, 423, 446/475; 273/86 D, 129 S, 129 T; 124/49, 47, 21, 26, 51.1

[56] References Cited

U.S. PATENT DOCUMENTS

| | | | |
|---|---|---|---|
| 1,791,071 | 2/1931 | Coggon . | |
| 3,803,756 | 4/1974 | Strongin . | |
| 3,908,303 | 9/1975 | McKay et al. . | |
| 4,108,437 | 8/1978 | DeAnda et al. | 273/86 D |
| 4,267,661 | 5/1981 | Hanson | 446/430 |
| 4,468,031 | 8/1984 | Barlow et al. | 446/445 X |
| 4,513,967 | 4/1985 | Halford et al. . | |
| 4,605,230 | 8/1986 | Halford et al. | 273/129 AP |
| 4,642,066 | 2/1987 | Kennedy et al. | 446/430 X |
| 4,690,658 | 9/1987 | Crosson et al. | 446/429 |

*Primary Examiner*—Mickey Yu
*Attorney, Agent, or Firm*—Roy A. Ekstrand

[57] ABSTRACT

A toy vehicle launcher includes a generally planar base having a pair of angularly disposed downwardly sloped toy vehicle feed ramps coupled thereto. A pivotally supported carriage defines a pair of angularly disposed launching stations for receiving toy vehicles from the feed ramps. An operative mechanism is coupled to a slidable handle supported upon the base to pivot the carriage back and forth between the feed ramps to alternate each launching station between a vehicle receiving position in alignment with a feed ramp and a launching position. A movable spring-loaded striker is operative in response to handle motion to strike the toy vehicle positioned within the launch position and drive the vehicle outwardly from the launcher.

8 Claims, 5 Drawing Sheets

RAPID ACTION TOY VEHICLE LAUNCHER

FIELD OF THE INVENTION

This invention relates generally to toy vehicles and particularly to the launching mechanisms used therein.

BACKGROUND OF THE INVENTION

Through the years, many vehicle playsets have been developed which include a toy vehicle launcher. While the structures for such toy vehicle launchers varies considerably between manufacturers, all generally include a base member or base housing within which a vehicle launching station is formed. A launching mechanism is generally supported within the base member and includes an interactive launcher arm or plunger which communicates the launcher mechanism to a toy vehicle positioned within the launched station. The launcher mechanism usually derives its energy from a spring drive or compressed air drive system. The object of the launcher's operation is to impart a great deal of kinetic energy to the toy vehicle within the launch station and propel it outwardly from the launcher station into a track or other travel area.

U.S. Pat. No. 4,690,658 issued to Crosson, et al. sets forth a TOY CAR LAUNCHER WITH EXPANDABLE SCISSORS MEMBERS in which a generally planar housing defines a launch channel for receiving a to-be-launched toy vehicle. The housing further supports an upwardly extending pistol grip handle having a trigger mechanism therein. A scissors mechanism is coupled to the trigger of the pistol grip handle and is rapidly expanded in response to actuation of the pistol grip handle trigger to expand the scissors members and launch the toy vehicle from the base member.

U.S. Pat. No. 4,513,967 and U.S. Pat. No. 4,605,230, a division thereof, issued to Halford, et al. sets forth a TOY VEHICLE GAME WITH LAUNCHER AND RETURN MEANS in which a pair of intersecting track segments each include respective launching apparatus and rebound return mechanisms at opposite ends thereof. In pertinent part, the launcher mechanism comprises a base member having a movable piston together with an air bellows operatively coupled to the piston. The rapid compression of the air bellows produces compressed air within the cylinder supporting the movable piston causing the piston to be driven outwardly from the cylinder thereby accelerating a toy vehicle positioned in proximity to the piston.

U.S. Pat. No. 4,108,437 issued to DeAnda, et al. sets forth a TOY VEHICLE STARTING AND LAUNCHING SET in which a pair of toy vehicle launchers are positioned in a side by side relationship and coupled to a corresponding pair of generally straight track members. The launchers include a starting apparatus and a gravity operated timer. A pusher arm is coupled to an elastic band and is drawn backwardly against the elastic force of the elastic band to provide a launching mechanism. A trigger release is provided to lock the pusher in an extended position and release the pusher to launch the toy vehicle.

U.S. Pat. No. 3,908,303 issued to McKay, et al. sets forth a SHIFT COUNSEL INCLUDING MEANS FOR FEEDING AND LAUNCHING VEHICLES having a launching station which supports a plunger-like launcher member for striking and launching a vehicle positioned in the launch station. A simulated gear shift lever connected with the plunger provides for cocking and releasing the plunger to launch toy vehicles. An inclined ramp is provided to receive a plurality of toy vehicles and feed them to the launch station in serial fashion.

U.S. Pat. No. 3,803,756 issued to Strongin sets forth a TOY VEHICLE AND LAUNCHING DEVICE THEREFOR including a platform upon which a toy vehicle is received and a motor interconnected to a flywheel rotatably supported within the toy vehicle. The motor rotates the vehicle flywheel while the vehicle is maintained in stationary position to store rotating energy therein. During launch, the motor is disconnected and the flywheel is simultaneously moved into engagement with the platform causing the vehicle to be propelled away from the launch station.

U.S. Pat. No. 4,468,031 issued to Barlow, et al. sets forth a THREE-DIMENSIONAL GAME WITH ROTATABLE TRACK PIECES FOR SELF-PROPELLED VEHICLE in which a predetermined course includes a plurality of rotational track members. The track members are mounted upon a support frame so as to be rotatable into a plurality of positions. Rotation of the track members is accomplished through manipulation of a set of attached knobs which are operated to alter the course configuration encountered by the self-powered vehicle.

U.S. Pat. No. 1,791,071 issued to Coggon sets forth an APPARATUS FOR PLAYING GAMES in which a play surface is provided with a plurality of track paths which multiply intersect at a plurality of intersections. Each intersection is provided with a rotatable turntable-like device which alters the travel of a cooperating toy vehicle at each intersection.

While the foregoing described prior art toy vehicle launchers and playsets have, in many instances, provided substantially increased enjoyment and amusement value, there remains a continuing need in the art for evermore improved and excited toy vehicle launchers.

SUMMARY OF THE INVENTION

Accordingly, it is a general object of the present invention to provide an improved toy vehicle launcher. It is a more particular object of the present invention to provide an improved toy vehicle launcher capable of rapid firing or launching action. It is more particular object of the present invention to provide a rapid action toy vehicle launcher which automatically reloads a series of toy vehicle following each toy vehicle launching.

In accordance with the present invention, there is provided a toy vehicle launcher comprises: a base defining a launch platform; a carriage pivotally coupled to the launch platform defining a pair of launch stations each configured to receive a toy vehicle; a pair of feed ramps coupled to the launch platform for receiving a plurality of toy vehicles; means for accelerating a toy vehicle; and operative means coupled to the carriage for pivotally moving the carriage to align one of the launch stations with one of the feed ramps and to align the other of the launch stations with the means for accelerating and for activating the means for accelerating.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
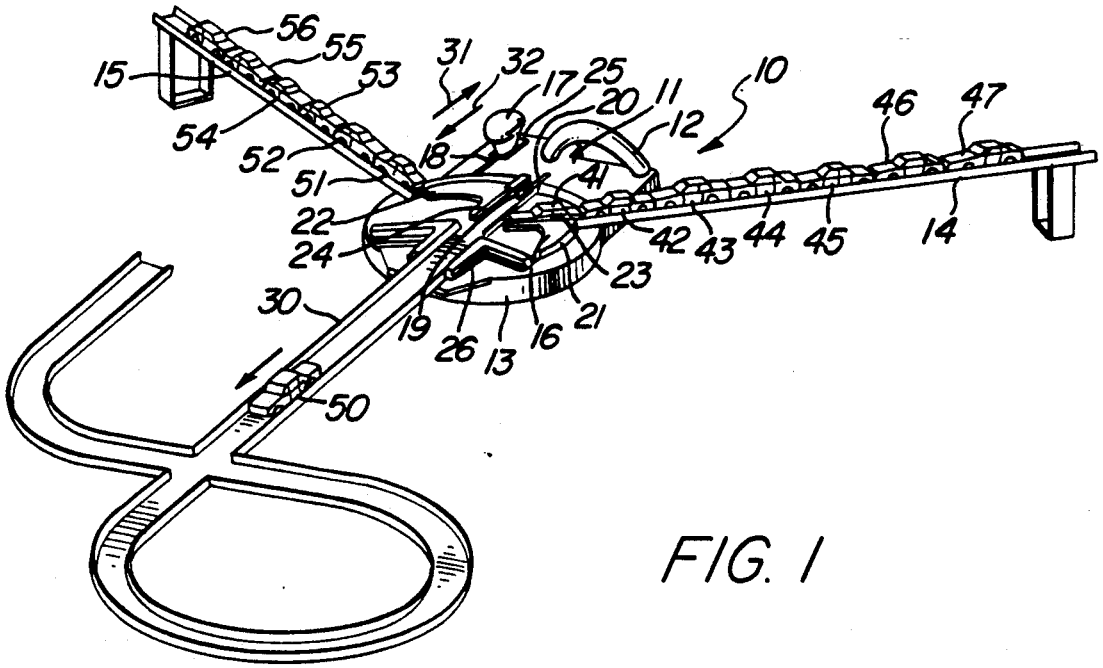
FIG. 1 sets forth a perspective view of a toy vehicle launcher and playset constructed in accordance with the present invention.

FIG. 1 sets forth a perspective view of a toy vehicle playset having a vehicle launcher constructed in accordance with the present invention and generally referenced by numeral 10. Launcher 10 includes a generally planar base 11 supporting a circular wheel grip 12 and defining a pair of elongated slots 18 and 20. Base 11 further defines a circular platform 13 which in turn defines a forwardly extending launch gate 26. Launch gate 26 is further coupled to an extending track 30. A pivotal carriage 16 defines a pair of arced sidewalls 21 and 22 together with a pair of launch stations 23 and 24. In accordance with an important aspect of the present invention, launch stations 23 and 24 are angularly displaced from each other. Launcher 10 further includes a movable striker 19 supported within slot 20 and a slide 25 movable within slot 18. Slide 25 supports a handle 17 extending upwardly therefrom. Launcher 10 further includes a pair of inclined angularly displaced feed ramps 14 and 15 coupled to circular platform 13. A vehicle 50 is positioned within launch station 24 of pivotal carriage 16. Similarly, a vehicle 41 is positioned within launch station 23 of pivotal carriage 16. Feed ramps 14 and 15 are inclined downwardly toward circular platform 13. As a result, toy vehicles positioned upon ramps 14 and 15 are urged downwardly toward circular platform 13 by the force of gravity. A plurality of toy vehicles 42 through 47 are positioned upon feed ramp 14 and thus are urged downwardly toward toy vehicle 41. Similarly, a plurality of toy vehicles 51 through 56 are supported upon feed ramp 15 and are urged downwardly toward circular platform 13.

In operation, circular platform 13 is positioned as shown in FIG. 1 having received toy vehicle 50 within launch station 24 and toy vehicle 41 within launch station 23. With launcher 10 initially in the position shown in FIG. 1, toy vehicle 50 is positioned within launch station 24 in alignment with striker 19 and launch gate 26. In addition, launch station 23 is positioned in alignment with feed ramp 14. Pivotal carriage 16 also defines a pair of curved upwardly extending wall portions 21 and 22 on either side of launch stations 23 and 24 respectively. As can be seen in FIG. 1 with pivotal carriage 16 in the position shown, wall 22 is positioned to partially obstruct the end portion of feed ramp 15. As a result, toy vehicles 51 through 56 supported upon inclined feed ramp 15 are maintained in the position shown. The operation of launcher 10 is initiated by the user in grasping handle 17 and forcing handle 17 forwardly in the direction of arrow 32 to move slide 25 within slot 18. By the operative mechanism set forth below, the movement of handle 17 and slide 25 in the direction indicated by arrow 32 draws striker 19 rearwardly within slot 20 and away from launch station 24 of pivotal carriage 16. Once striker 19 is withdrawn from launch station 24, the continued forward motion of handle 17 and slide 25 in the direction indicated by arrow 32 causes striker 19 to be further withdrawn rearwardly and causes pivotal carriage 16 to pivot in a counterclockwise direction bringing launch station 23 into alignment with striker 19 and launch gate 26. The pivotal motion of pivotal carriage 16 also brings launch station 24 into alignment with the end portion of feed ramp 15. Thus, as pivotal carriage 16 is pivoted in the counterclockwise direction and launch station 24 is aligned with feed ramp 15, wall 22 no longer blocks the end portion of feed ramp 15. As a result, the gravitational force upon toy vehicles 51 through 56 urges the next toy vehicle, in this case vehicle 51, outwardly from feed ramp 15 into launch station 24. Concurrently, as pivotal carriage 16 is pivoted in the counterclockwise direction, wall 21 thereof blocks the end of feed ramp 14 and precludes further motion of toy vehicle 42.

The pivotal motion of carriage 16 continues as slide 25 is moved forwardly until the release mechanism for striker 19 set forth below in greater detail releases striker 19 which under the urging of a captive spring moves rapidly forward to impact vehicle 41 within launch station 23 causing vehicle 41 to be rapidly accelerated outwardly from circular platform 13 through launch gate 26.

Once vehicle 41 has been launched and vehicle 51 has automatically replaced vehicle 50 within launch station 24, the movement of handle 17 and slide 25 rearwardly in the direction indicated by arrow 31 causes the operative mechanism described below to again withdraw striker 19 rearwardly and pivot carriage 16. In this instance, however, the pivotal motion of carriage 16 is clockwise returning launch station 24 to alignment with striker 19 and launch gate 26 while returning the now empty launch station 23 to alignment with the end portion of feed ramp 14. Once again, the pivotal motion of carriage 16 removes the obstruction of ramp 14 provided by wall 21 and permits the next available toy vehicle to be loaded into launch station 23. With handle 17 and slide 25 returned to the fully rearward position shown in FIG. 1, striker 19 is again released by the below described mechanism to drive the toy vehicle (in this case vehicle 51) outwardly from launch station 24 through launch gate 26 and down track 30.

This process may be repeated in rapid succession by the user rapidly moving handle 17 back and forth within slot 18 causing alternate counterclockwise and clockwise pivotal motion of carriage 16 and the withdrawal and release of striker 19. Thus, in accordance with an important aspect of the present invention, it should be noted that as handle 17 and slide 25 are moved back and forth, the pivotal motion of carriage 16 brings a loaded launch station into alignment with striker 19 and launch gate 26 while simultaneously bringing an empty launch station into alignment with a feed ramp to replace the previously discharged or launched vehicle. Thus, rapid back and forth motion of handle 17 provides correspondingly rapid pivotal motion of carriage 16 and striker 19 to provide a rapid series of toy vehicles launches providing substantially enhanced play value and excitement for the user.

Figure 2:
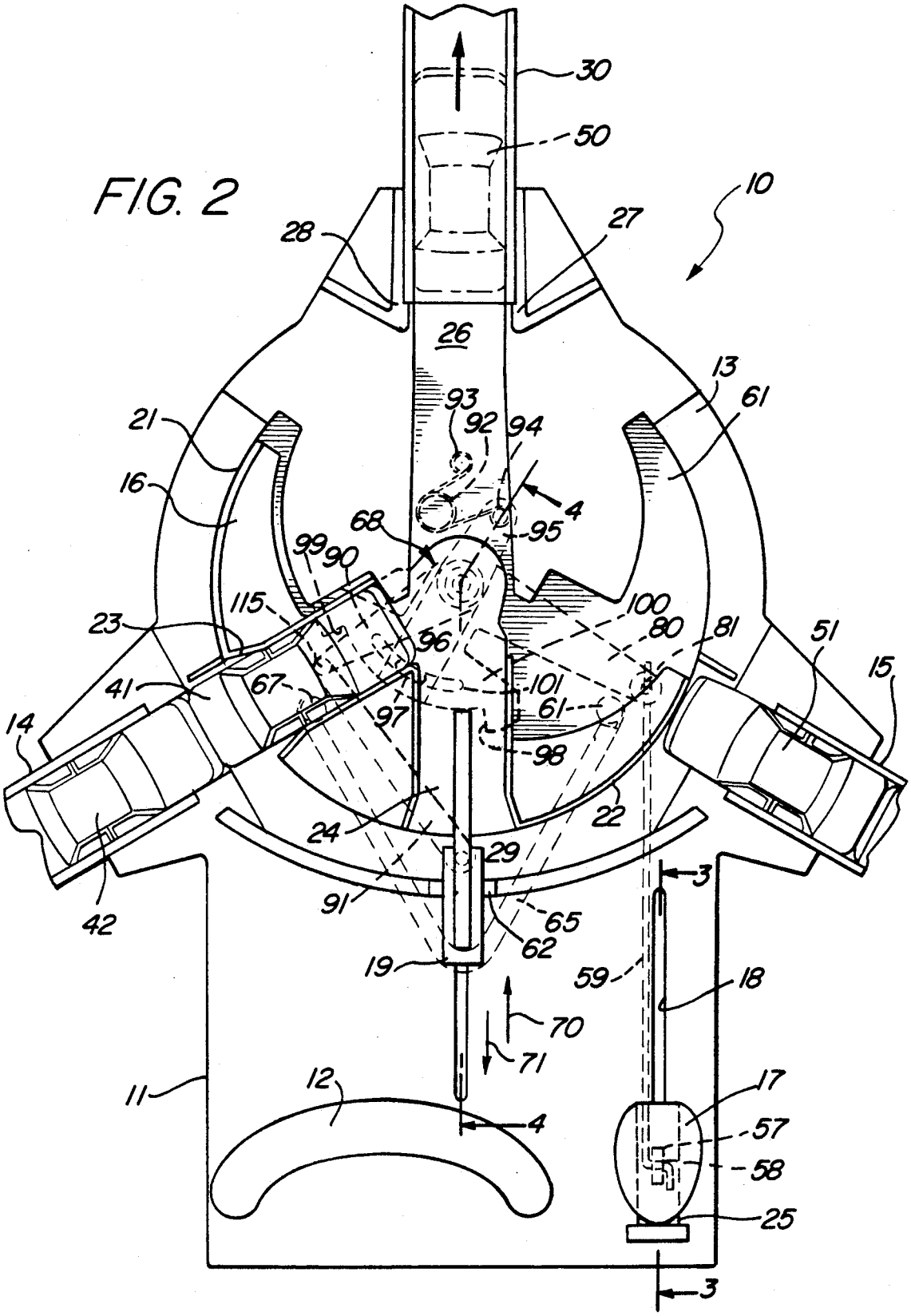
FIG. 2 sets forth a toy plan view of the launcher portion of the toy vehicle playset of FIG. 1.

FIG. 2 sets forth an enlarged top view of launcher 10 in the operation position shown in FIG. 1. As described above, launcher 10 includes a generally planar base 11 having a circular platform 13 coupled to a pair of angularly disposed feed ramps 14 and 15 on either side of the center line thereof. Base 11 further defines an elongated slot 18 within which a slot 25 is received and movable in the manner described above. Slide 25 supports a handle 17 facilitating the movement of slide 25 back and forth within slot 18. Base 11 further defines an elongated slot 20 having a movable striker 19 supported therein. Striker 19 is free to travel back and forth within slot 20 and supports a forwardly extending hammer portion 29. By means set forth below in greater detail, striker 19 defines a downwardly extending portion beneath base 11 which is coupled to an elongated coil spring 65, the ends of which are coupled to a pair of attachment posts 66 and 67. Spring 65 is operative to urge striker 19 forwardly in the direction indicated by arrow 70.

A pivotal carriage 16 is pivotally movable upon platform 13 by means set forth below in greater detail and defines a pair of arc-shaped walls 21 and 22. Pivotal carriage 16 is generally semi-circular in shape and defines a pair of angularly disposed launch stations 23 and 24 configured for receiving toy vehicles such as vehicles 41 through 47 and 50 through 56 (seen in FIG. 1). Pivotal carriage 16 is pivotally supported at a center pivot 68 in the manner set forth below in FIG. 4 in greater detail.

The operative mechanism of launcher 10 is set forth below in greater detail. However, suffice it to note here that launcher 10 further includes an actuator 100, an arm 95, a connecting rod 59 and a pair of series coupled arms 90 and 91 supported beneath the upper surface of base 11 and circular platform 13. Actuator 100 includes an extending pivot arm 80 having an aperture 81 defined therein. A connecting rod 59 is coupled to aperture 81 of arm 80 and extends generally parallel to slot 18 and is received within aperture 58 of tab 57. The latter extends downwardly on the underside of slide 25 as is better seen in FIG. 3. Actuator 100 further defines an arcuate slot 101. Pivotal carriage 16 defines a corresponding tab 96 which extends downwardly into slot 101 to coupled pivotal carriage 16 to actuator 100. Arm 95 is pivotally supported about pivot 68 and defines a post 94. A spring 92 is coupled to post 94 at one end and to a fixed post 93 formed on the underside of platform 13 at the remaining end. Arm 95 defines an aperture 97 which also receives tab 96 from carriage 16 thereby coupling arm 95 directly to carriage 16. Thus, arm 95 moves in a direct pivotal relationship to the pivotal motion of carriage 16 and cooperates with spring 92 to provide a "over-center" or snap-action which operates through arm 95 and carriage 16 to positively position carriage 16 in either of its alternate vehicle launch positions characterized by alignment of launch stations 23 and 24 with striker 19 and launch gate 26. The series combination of connecting arm 90 and connecting arm 91 is coupled between pivot 68 and striker 19. Correspondingly, actuator 100 defines a pair of extending tabs 98 and 99 which couple the pivotal motion of actuator 100 to arm 90 to provide the rearward motion of striker 90 in the direction of arrow 71 described above as handle 17 and slide 25 are moved.

In the operative position shown in FIG. 2, handle 17 and slide 25 occupy their rearmost position within slot 18. Correspondingly, striker 19 occupies its forwardmost position within slot 20 and extends into launch station 24. In this position, launch station 23 is aligned with feed ramp 14 permitting toy vehicle 41 to move from feed ramp 14 into launch station 23. Concurrently, the position of carriage 16 shown in FIG. 2 places wall 22 in an obstructing position for the end portion of ramp 15 which in turn precludes further movement by toy vehicle 51. Thus, the position shown in FIG. 2 sets forth the relative position of the operative components of launcher 10 corresponding to a completed vehicle launch. Thus, it should be understood that a vehicle previously received within launch station 24 has been impacted by striker 19 and now travels outwardly through launch gate 26 as shown by dashed line representation 50 of a toy vehicle.

The next operative cycle of launcher 10 is undertaken by movement of handle 17 forwardly within slot 18. This forward motion is communicated by connecting rod 59 to arm 80 of actuator 100 causing it to pivot. The pivotal motion of actuator 100 is coupled directly to arm 95 by tab 96. Initially, however, the length of slot 101 precludes operative coupling between actuator 100 and tab 96 of carriage 16. Thus, carriage 16 initially remains unmoved as handle 17 is moved forwardly. The rotation of actuator 100 brings tab 99 against arm 90 causing arm 90 to pivot in a counterclockwise direction. The pivotal motion of arm 90 is coupled to striker 19 by arm 91 forcing striker 19 rearwardly in the direction indicated by arrow 71 and overcoming the force of spring 65. With continued forward motion of handle 17, the rotation of actuator 100 continues and striker 19 is withdrawn from launch station 24. Once striker 19 is withdrawn from launch station 24, tab 96 contacts the end portion of slot 101 of actuator 100 and further rotation of actuator 100 produces a corresponding rotation of carriage 16. As handle 17 continues to move forwardly, the rotation of actuator 100 continues causing the simultaneous rotation of carriage 16 and the rearward motion of striker 90.

As carriage 16 pivots about pivot 68, wall 21 moves into an obstructing position for feed ramp 14 precluding further inward motion of toy vehicle 42. Similarly, the extension of wall 22 continues to preclude further motion of toy vehicle 51. Thus, as carriage 16 continues to pivot and striker 19 continues to move rearwardly under the urging of handle 17, launch station 24 is brought into alignment with ramp 15 and launch station 23 supporting toy vehicle 41 is moved into alignment with striker 19 and launch gate 26.

The operative sequence of the launching mechanism of launcher 10 is set forth below in FIGS. 5 through 9 in greater detail. However, suffice it to note here that as the user continues to move handle 17 forwardly, launch station 24 is moved into alignment with ramp 15 permitting toy vehicle 51 to move into launch station 24. Simultaneously, launch station 23 is moved into alignment with striker 19 and launch gate 26. As actuator 100 continues to pivot, arms 90 and 91 are moved into a straight line alignment which provides the maximum rearward extension of striker 19 in the direction of arrow 71. This position is unstable due to the spring force of spring 65 and, as a result, the continuing motion of actuator 100 causes tab 99 to move arms 90 and 91 over-center or beyond the straight line orientation. Once arms 90 and 91 are pivoted a small increment beyond the straight line position, the force of spring 65 is no longer resisted and arms 90 and 91 are rapidly collapsed as arm 90 pivots counterclockwise and arm 91 pivots clockwise releasing striker 90 which is moved forwardly into the launch station under the urging of spring 65 to impact the toy vehicle therein and drive the to vehicle outwardly through launch gate 26 unto track 30.

With the launch cycle completed and handle 17 at its forwardmost position within slot 18, the launch cycle may be repeated through the user's drawing of handle 17 rearwardly within slot 18 which in the manner described above withdraws striker 19 from launch station 23 and pivots carriage 16 in a clockwise direction to return launch station 23 to alignment with feed ramp 14 and to return launch station 24 to alignment with striker 19 and launch gate 26. Once again, further movement of handle 17 in the rearward direction release striker 19 due to the over-center snap-action of arms 90 and 91 thereby permits spring 65 to move striker 19 forwardly into launch station 24 and impact a toy vehicle loaded therein.

It will be apparent to those skilled in the art that the launching action of launcher 10 is extremely rapid and the alternate clockwise and counterclockwise motion of carriage 16 which permits simultaneously launch and loading of toy vehicles provides extremely rapid vehicle launch capability. In addition, it will be equally apparent that the bidirectional action of the launch mechanism which provides vehicle launch at both ends of the travel of handle 17 and slide 25 further enhances the rapid launch capability of launcher 10 in that no return stroke or cocking motion is necessary since vehicles are launched in both directions of handle motion.

Figure 3:
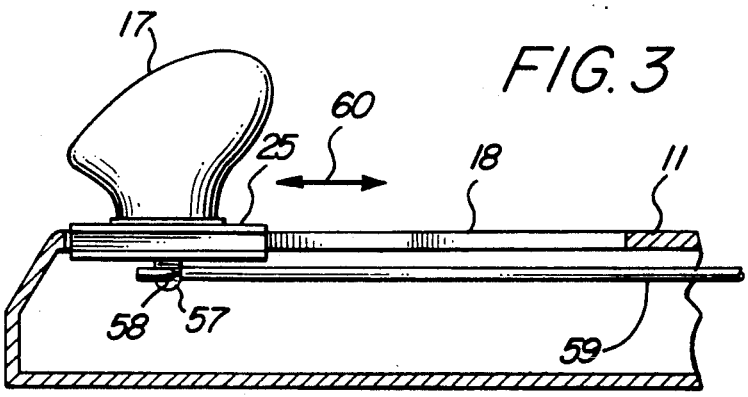
FIG. 3 sets forth a section view of the present invention toy vehicle launcher taken along section lines 3—3 in FIG. 2.

FIG. 3 sets forth a partial section view of launcher 10 taken along section lines 3—3 in FIG. 2. As described above, base 11 defines an elongated slot 18 which receives a slide 25 in a slidable attachment. As is also described above, slide 25 supports a user operated handle 17 and a downwardly extending tab 57. Tab 57 defines an aperture 58. A connecting rod 59 defines a curved end portion which is received within aperture 58 of tab 57 and which provides operative coupling between actuator 100 (seen in FIG. 2) and slide 25. In accordance with the action described above, handle 17 is moved by the user to cause corresponding motion of slide 25 back and forth in the directions indicated by arrows 60 within slot 18. This back and forth motion is coupled by connecting rod 59 to actuator 100.

Figure 4:
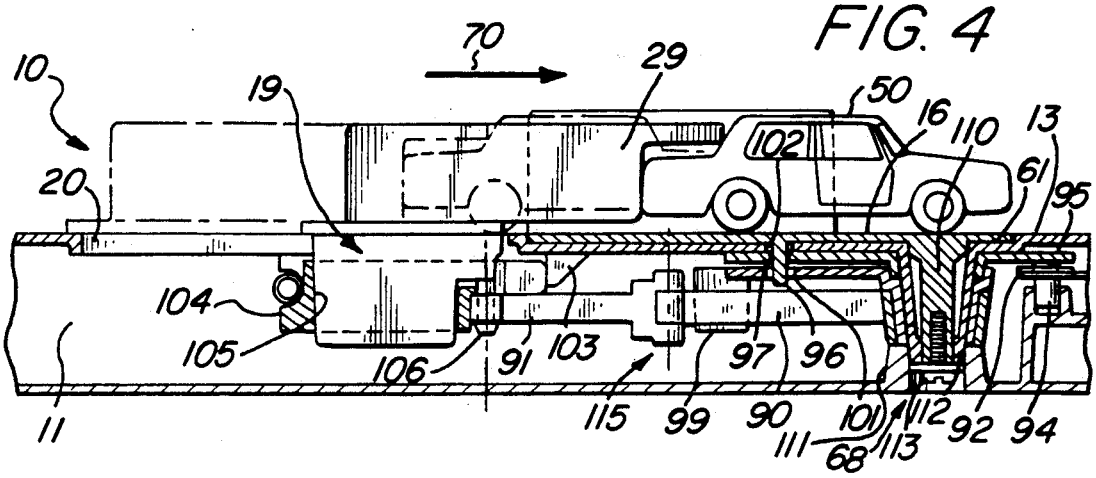
FIG. 4 sets forth a section view of the present invention toy vehicle launcher taken along section lines 4—4 in FIG. 2.

FIG. 4 sets forth a partial section view of launcher 10 taken along section lines 4—4 in FIG. 2. As described above, base 11 defines an elongated slot 20 which receives and supports striker 19. Striker 19 supports a forwardly extending hammer portion 29 and extends downwardly through slot 20. A traveler 104 defines a slot 105 which receives the lower portion of striker 19 and which defines a downwardly extending post 106. Traveler 104 is secured to striker 19 to captivate striker 19 within slot 20. A travel limit stop 103 extends downwardly in the forwardmost point of the travel path for striker 19. As is also described above, base 11 defines a circular platform 13 which in turn defines a recess 61. Pivotal carriage 16 is received within recess 61 and defines a downwardly extending tab 96. Pivotal carriage 16 further defines a downwardly extending post 110 which is received by pivot 68. Base 11 further defines an upwardly extending boss 111 and a downwardly extending boss 112. Bosses 111 and 112 are joined to form the support structure for pivot 68. A fastener 113 is received within post 110 of carriage 16 and captivates pivotal carriage 16 in a pivotal attachment to boss 112. A pivotal arm 95 is received upon boss 112 in a pivotal attachment and defines a post 94 at one end and an aperture 97 at the opposite end. Aperture 97 receives tab 96 to provide coupling between carriage 16 and arm 95. Recess 61 defines an elongated slot 102 which permits tab 96 to extend downwardly therethrough. A spring 92 is coupled to post 94 and to a fixed post 93 (seen in FIG. 5).

Figure 5:
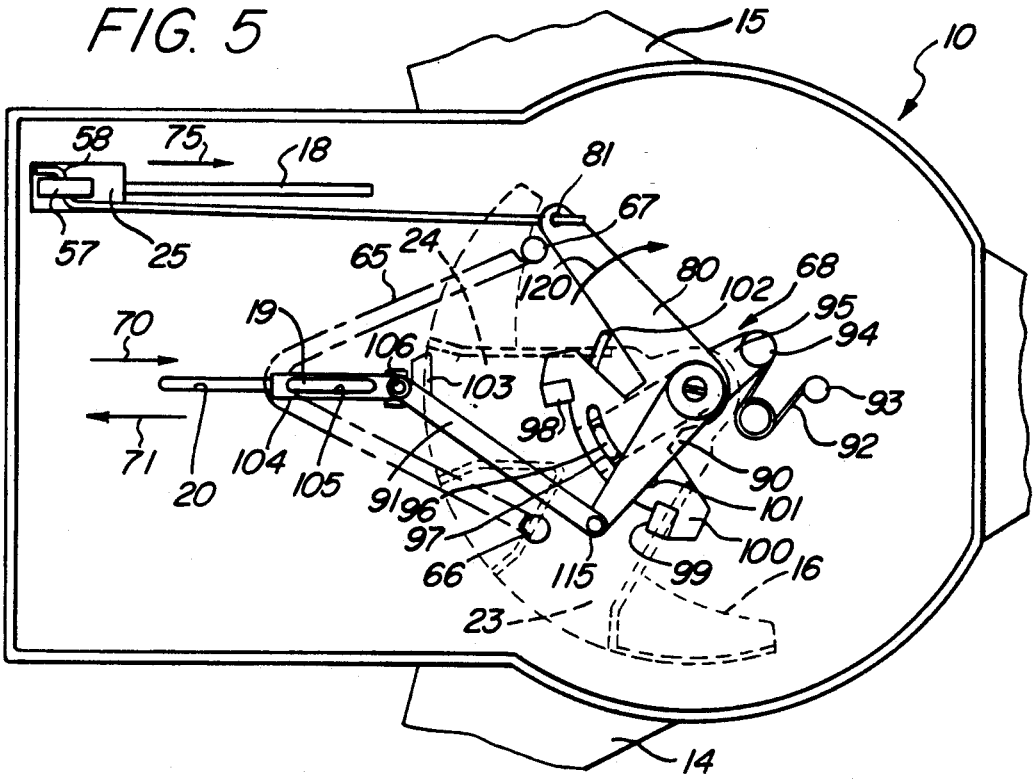
FIGS. 5 through 9, inclusive, set forth sequential bottom views of the present invention toy vehicle launcher operational cycle.

An actuator 100 is pivotally received upon boss 112 and defines an arcuate slot 101 and a pair of tabs 99 and 98 (the latter seen in FIG. 5). An arm 90 is pivotally supported upon actuator 100 and pivots about pivot 68. Arm 90 is coupled to one end of an arm 91 by a coupling 115. The remaining end of arm 91 is coupled to post 106 of traveler 104.

Figure 6:
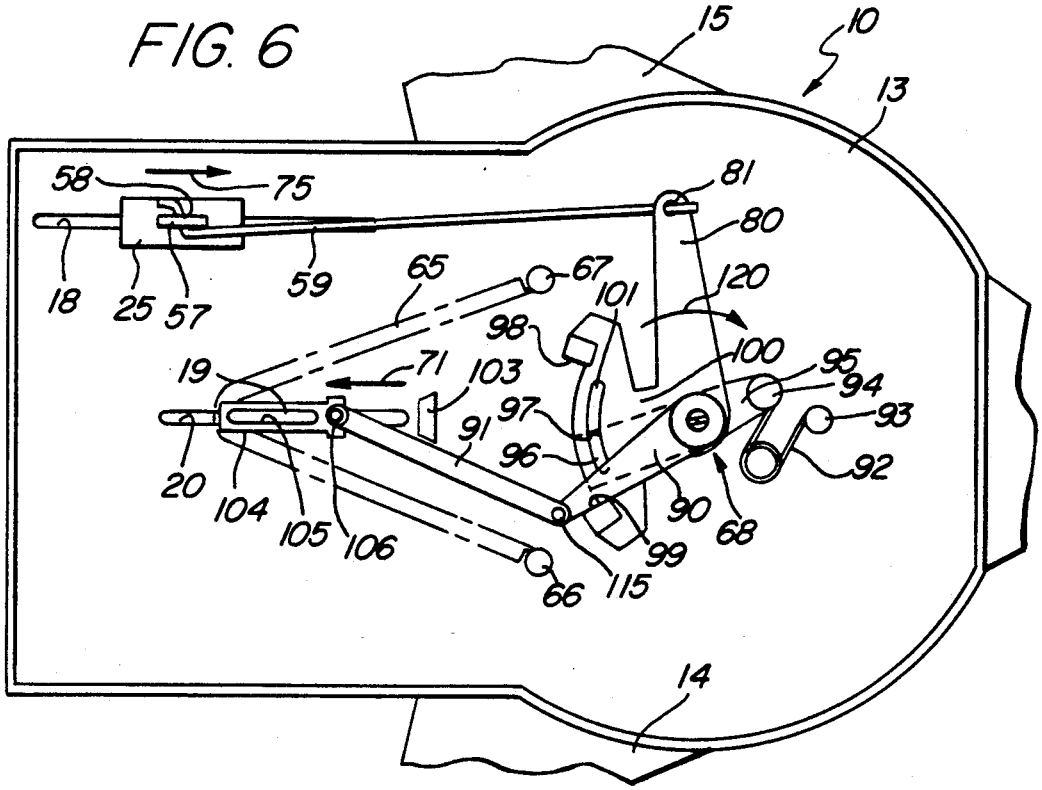

FIGS. 5 through 9 set forth sequential stages of the operation of the present invention vehicle launch mechanism. By way of overview, FIG. 5 depicts the operative position of launcher 10 shown in FIG. 5 corresponds to the position shown in FIGS. 1 and 2 which as described above correspond to the end point of the previous launch cycle in which striker 19 has launched a vehicle from launch station 24 (seen in FIG. 2). FIG. 6 sets forth the initiation of the next launch cycle in which the user has moved slider 25 forwardly causing striker 19 to be withdrawn from launch station 24 and causing carriage 16 to begin pivotal motion.

Figure 7:
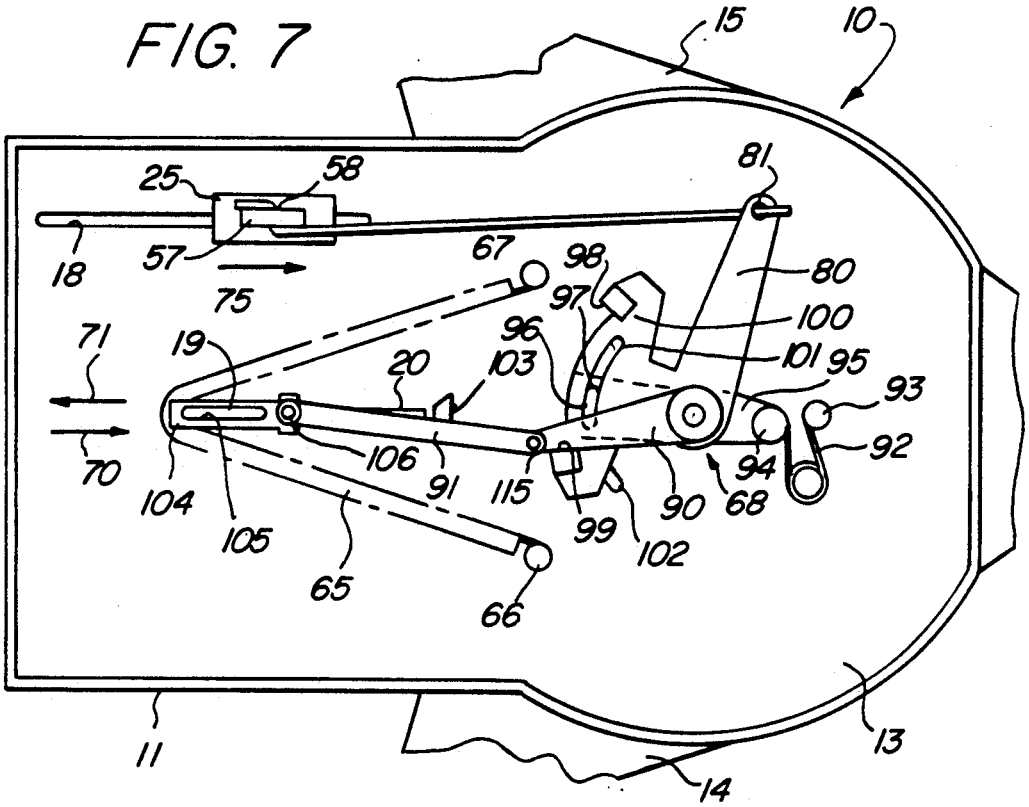
Figure 8:
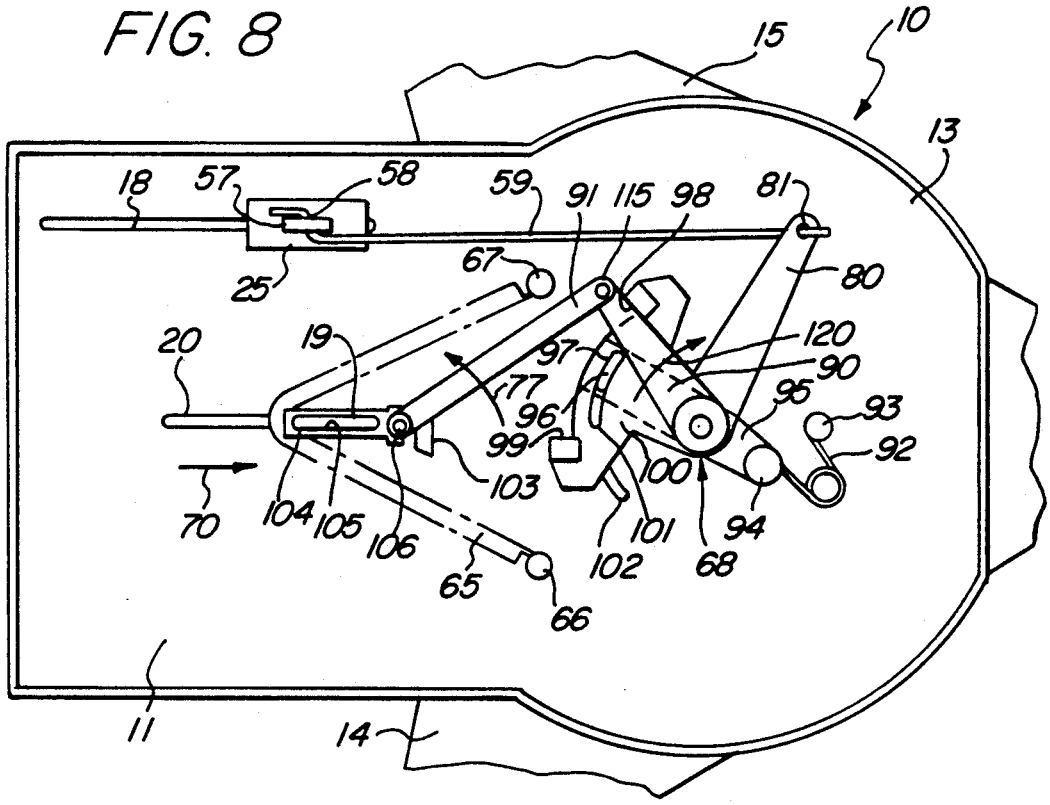
Figure 9:
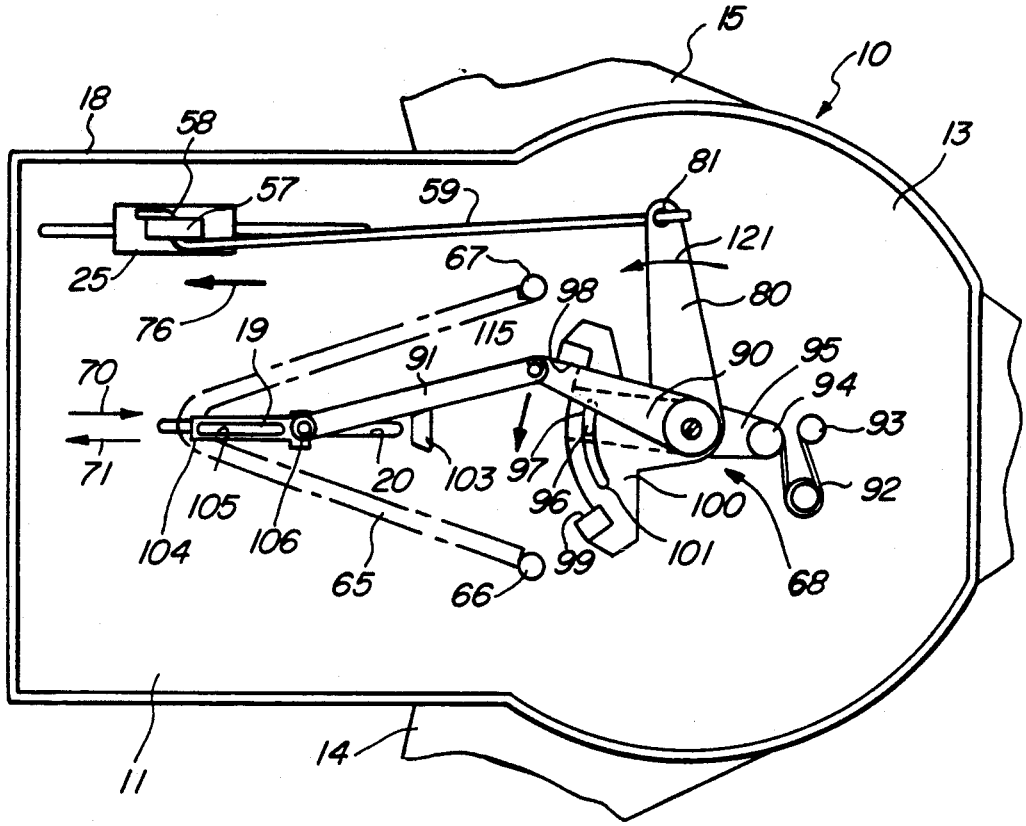

FIG. 7 sets forth the rearmost travel position of striker 19 at slide 25 is moved forwardly and as carriage 16 continues to pivot bringing launch station 23 into alignment with striker 19. FIG. 8 sets forth the initiation of vehicle launch as arms 90 and 91 move over-center releasing striker 19 and permitting spring 65 to accelerate striker 19 forwardly. Concurrently, FIG. 8 shows the over-center snap action of spring 92 upon carriage 16 to positively lock carriage 16 into the proper alignment of launch station 23. FIG. 9 sets forth the initiation of the next launch cycle as slider 25 is moved rearwardly withdrawing striker 19 and pivoting carriage 16 in the opposite direction to align launch station 24 with striker 19.

Specifically, FIG. 5 sets forth a bottom view of launcher 10. As described above, launcher 10 includes a planar base 11 defining a pair of slots 18 and 20 and a circular platform 13. A pair of feed ramps 14 and 15 are angularly disposed with respect to base 11 and coupled to circular platform 13. A slider 25 is received within slot 18 and defines a downwardly extending tab 57 which in turn defines an aperture 58. A connecting rod 59 has one end received within aperture 58 and the remaining end received within an aperture 81 defined in arm 80 of an actuator 100. Actuator 100 is pivotally secured to circular platform 13 by a pivot mechanism (better seen in FIG. 4). Actuator 100 defines an arcuate slot 101 and a pair of extending tabs 98 and 99. Pivotal carriage 16 is pivotally coupled to pivot 68 and defines a downwardly extending tab 96. A slot 102 is formed in circular platform 13 to receive tab 96. An arm 95 is pivotally secured by pivot 68 and defines a post 94 at one end and an aperture 97 at the opposite end. The latter receives tab 96 to provide direct coupling between arm 95 and pivotal carriage 16. A spring 92 couples post 94 of arm 95 to a fixed post 93 supported upon the underside of platform 13.

A striker 19 extends downwardly through slot 20 and is received within slot 105 of a traveler 104. Traveler 104 in turn defines a post 106. A pair of arms 90 and 91 are pivotally secured to pivot 68 and post 106 respectively and mutually coupled at a pivoting coupling 115. A spring 65 is coupled to posts 66 and 67 and to striker 19. Spring 65 provides a spring force urging striker 19 in the direction indicated by arrow 70.

As described above, the operation of launcher 10 is initiated by the movement of slider 25 forwardly in the direction indicated by arrow 75. At the position shown in FIG. 5, the initial movement of slider 25 in the direction indicated by arrow 75 is coupled to arm 80 of actuator 100 by connecting rod 59 causing arm 80 and actuator 100 to be pivoted in the direction indicated by arrow 120. As actuator 100 pivots, tab 99 is brought into contact with arm 90 causing arm 90 to also begin pivoting in the direction indicated by arrow 120. During this initial movement of actuator 100, slot 101 is moved with respect to tab 96 which delays the pivotal motion of carriage 16. Once tab 99 contacts arm 90, the continuing pivotal motion of actuator 100 caused by further movement of slider 25 in the direction of arrow 75 causes arm 90 to continue pivoting in the direction indicated by arrow 120 forcing striker 19 rearwardly within slot 20 in the direction of arrow 71 due to the coupling of arm 91.

FIG. 6 sets forth the next operational stage in the function of launcher 10 as slider 25 continues to be moved forwardly in the direction indicated by arrow 75. The operational stage shown in FIG. 6 shows actuator 100 pivoted in the direction of arrow 120 to the point where the end of slot 101 contacts tab 96. The pivotal motion of arm 90 and the coupling of arm 91 has driven striker 19 in the direction of arrow 71 overcoming the force of spring 65. The continued forward motion of slider 25 continues to pivot actuator 100. However, the contact of tab 96 of carriage 16 with the end point of slot 101 of actuator 100 now provides a coupling between actuator 100 and carriage 16. As a result, carriage 16 (seen in FIG. 2) now begins pivotal motion in the direction indicated by arrow 120.

FIG. 7 sets forth the next operative stage in the function of launcher 10 in which slider 25 has been moved forwardly in the direction of arrow 75 and approaches its maximum forward position. Correspondingly, the forward motion of slider 25 has pivoted actuator 100 in the direction of arrow 120 causing carriage 16 to be pivoted correspondingly and to pivot arms 90 and 91 into a near straight line relationship which moves striker 19 rearwardly in the direction of arrow 71 causing spring 65 to be stretched maximally. Correspondingly, the pivotal motion of carriage 16 also pivots arm 95 bringing posts 94 and 93 into an aligned position and torquing spring 92. Thus, the position shown in FIG. 7, corresponds to the point of the launch cycle of launcher 10 in which the combination of arms 90 and 91, spring 65 and slider 19 approach the over-center or snap-action point which results in releasing striker 19. The next small pivoting motion of actuator 100 moves coupling 115 over-center to a position from which resisting force is no longer provided by arms 90 and 91. As a result, the spring force of spring 65 rapidly accelerates striker 19 in the direction of arrow 70 causing arm 90 to pivot rapidly in the direction of arrow 120 and causing arm 91 to pivot rapidly about post 106 in the direction of arrow 77. Concurrently, as actuator 100 pivots to force arms 90 and 91 over-center, post 94 of arm 95 is also moved over-center with respect to stationary post 93. The result is a snap-action movement in which spring 92 rapidly forces arm 95 and carriage 16 to quickly pivot in the direction of arrow 120 which aligns carriage 16 for vehicle launch.

FIG. 8 sets forth the operational position of launcher 10 as striker 19 moves rapidly forward in the direction of arrow 70 to complete the toy vehicle launch described above. Striker continues its forward motion in the direction of arrow 70 until traveler 104 impacts limit 103 completing the launch cycle.

FIG. 9 sets forth the initiation of the next launch cycle which the user begins by moving slider 25 in the direction indicated by arrow 76. The motion of slider 25 in the direction indicated by arrow 76 causes actuator 100 to be pivoted in the direction of arrow 121 bringing tab 98 of actuator 100 into contact with arm 90 and pivoting arm 90 to again move arms 90 and 91 toward straight line alignment and force striker 19 rearwardly in the direction indicated by arrow 71. This motion continues as slider 25 is moved rearwardly in the direction of arrow 76 pivoting actuator 100 further in the direction of arrow 121 and moving arms 90 and 91 into a straight line alignment in which striker 19 has been moved rearward stretching spring 65 maximally and approaching the snap-action or over-center position of arms 90 and 91. As slider 25 continues to move in the direction of arrow 76, the pivotal motion of actuator 100 drives arms 90 and 91 over-center providing a snap-action similar to that described above but in the opposite direction which again collapses arms 90 and 91 and releases the retaining force upon striker 19. With the collapse of the restraining force provided by arms 90 and 91, spring 65 rapidly moves striker 19 forwardly in the direction of arrow 70 to initiate the next vehicle launch.

This launching process may be carried forward indefinitely as long as toy vehicles are provided upon ramps 14 and 15 as the user rapidly moves handle 17 and slider 25 back and forth within slot 18.

What has been shown is a rapid action toy vehicle launcher which utilizes a pivoting carriage to alternately load and launch a succession of toy vehicles between alternative launch stations defined upon the pivoting carriage. The actuating mechanism responds to motion of the launch handle in either direction and eliminates the need for a return action or cocking motion of the launch mechanism. Thus, an extremely rapid launching action is achieved.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle launcher comprising:

a base defining a launch platform;

a carriage pivotally coupled to said launch platform defining a pair of launch stations each configured to receive a toy vehicle;

a pair of feed ramps coupled to said launch platform for receiving a plurality of toy vehicles;

means for accelerating a toy vehicle; and operative means coupled to said carriage for pivotally moving said carriage to align one of said launch stations with one of said feed ramps and to align the other of said launch stations with said means for accelerating and for activating said means for accelerating.

2. A toy vehicle launcher as set forth in claim 1 wherein said operative means include a handle movable between first and second positions and wherein said operative means alternate said carriage motion to align one of said launch stations with one said feed ramps and the other of said launch stations with said means for accelerating in said first handle position and to said one of said launch stations with said means for accelerating and said other of said launch stations with the other of said feed ramps in said second handle position.

3. A toy vehicle as set forth in claim 2 wherein said feed ramps are downwardly inclined toward said launch platform.

4. A toy vehicle launcher as set forth in claim 3 wherein said pair of launch stations are angularly disposed by a first angle.

5. A toy vehicle launcher as set forth in claim 4 wherein said feed ramps are angularly disposed by a second angle which is substantially twice said first angle.

6. A toy vehicle launcher as set forth in claim 5 wherein said means for accelerating is angularly centered between said feed ramps.

7. A toy vehicle launcher comprising:

a base defining a launch platform;

a striker having a hammer portion, said striker being movable along a launch axis;

a carriage pivotally secured to said platform at a point generally on said launch axis and defining first and second vehicle launch stations inwardly angled toward said point at a first included angle;

first and second feed ramps coupled to said platform inwardly angled toward said point at a second included angle substantially twice said first angle; and operative means coupled to said carriage and said striker for pivoting said carriage between a first position in which said first launch station is aligned with said first feed ramp and said second launch station is aligned with said launch axis and a second position in which said second launch station is aligned with said second feed ramp and said first launch station is aligned with said launch axis and for moving said striker to drive a toy vehicle from each launch station each time it is moved from alignment with its respective feed ramp to alignment with said launch axis.

8. A toy vehicle launcher as set forth in claim 7 wherein said operative means include a handle movable between first and second positions and wherein said carriage is moved to its first and second positions respectively in response to handle movement to drive a toy vehicle from said second launch station in said first handle position and to drive a toy vehicle from said first launch station in said second handle position.

* * * * *